US009463509B2

(12) United States Patent
Nakayama et al.

(10) Patent No.: US 9,463,509 B2
(45) Date of Patent: Oct. 11, 2016

(54) RECYCLE METHOD AND RECYCLE APPARATUS FOR POWDER FOR RARE EARTH SINTERED MAGNET

(71) Applicant: HITACHI METALS, LTD., Minato-ku, Tokyo (JP)

(72) Inventors: Shoji Nakayama, Kumagaya (JP); Mitsuaki Mochizuki, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 389 days.

(21) Appl. No.: 14/348,099

(22) PCT Filed: Sep. 24, 2012

(86) PCT No.: PCT/JP2012/074380

§ 371 (c)(1),
(2) Date: Mar. 28, 2014

(87) PCT Pub. No.: WO2013/047429

PCT Pub. Date: Apr. 4, 2013

(65) Prior Publication Data

US 2014/0239098 A1 Aug. 28, 2014

(30) Foreign Application Priority Data

Sep. 30, 2011 (JP) ..... 2011-216466

(51) Int. Cl.

| | |
|---|---|
| ***B02C 23/36*** | (2006.01) |
| ***B22F 9/04*** | (2006.01) |
| ***H01F 41/02*** | (2006.01) |
| ***B02C 18/06*** | (2006.01) |
| *H01F 1/057* | (2006.01) |
| *B22F 9/00* | (2006.01) |

(52) U.S. Cl.

CPC ..... *B22F 9/04* (2013.01); *B02C 18/06* (2013.01); *B02C 23/36* (2013.01); *H01F 41/0253* (2013.01); *B22F 2009/001* (2013.01); *B22F 2009/042* (2013.01); *B22F 2009/046* (2013.01); *H01F 1/0577* (2013.01)

(58) Field of Classification Search

USPC ..... 241/21, 46.06

See application file for complete search history.

(56) References Cited

U.S. PATENT DOCUMENTS 9,358,614 B2 * 6/2016 Mochizuki ..... B22F 8/00

FOREIGN PATENT DOCUMENTS

| | | |
|---|---|---|
| EP | 1096517 A2 | 5/2001 |
| JP | 51-15770 U | 2/1976 |

(Continued)

OTHER PUBLICATIONS

International Search Report for PCT/JP2012/074380 dated Dec. 18, 2012, English Translation.

Communication dated Jun. 3, 2015, issued by the European Patent Office in counterpart Application No. 12835343.0.

*Primary Examiner* — Mark Rosenbaum

(74) *Attorney, Agent, or Firm* — Sughrue Mion, PLLC

(57) ABSTRACT

Provided are a recycle method and apparatus for effectively obtaining a recycled alloy powder which is hardly oxidized and which has substantially the same particle diameter as that of alloy powder used for forming a molded body, by using the molded body formed by press molding in manufacturing a rare earth sintered magnet. A method for recycling a powder containing a rare earth element, comprising the steps of: i) placing in an oil a molded body for a rare earth sintered magnet, the molded body comprising a powder containing a rare earth element; ii) arranging the oil and at least a part of the molded body in between a plurality of plate-like first crushing teeth opposed to each other and a plate-like second crushing tooth having at least its part positioned between the adjacent first crushing teeth; iii) rotating at least either one of the plurality of first crushing teeth and the second crushing tooth without contacting to each other such that the first crushing teeth and the second crushing tooth serve to change a part of the second crushing tooth positioned between the adjacent first crushing teeth.

7 Claims, 8 Drawing Sheets

(56) References Cited

FOREIGN PATENT DOCUMENTS

| | | | |
|---|---|---|---|
| JP | 59136907 | A | 8/1984 |
| JP | 4-83319 | A | 3/1992 |
| JP | 10-241981 | A | 9/1998 |
| JP | 2002313616 | A | 10/2002 |
| JP | 2004207578 | A | 7/2004 |
| JP | 2005-54261 | A | 3/2005 |
| JP | 2005-161779 | A | 6/2005 |
| JP | 2006314889 | A | 11/2006 |
| WO | 2007106773 | A1 | 9/2007 |
| WO | 2011/125578 | A1 | 10/2011 |

* cited by examiner

RECYCLE METHOD AND RECYCLE APPARATUS FOR POWDER FOR RARE EARTH SINTERED MAGNET

CROSS REFERENCE TO RELATED APPLICATIONS

This application is a National Stage of International Application No. PCT/JP2012/074380 filed Sep. 24, 2012 (claiming priority based on Japanese Patent Application No. 2011-216466 filed Sep. 30, 2011), the contents of which are incorporated herein by reference in their entirety.

TECHNICAL FIELD

The present invention relates to methods and apparatuses for recycling alloy powder for a rare earth sintered magnet, particularly, alloy powder for a rare earth sintered magnet (hereinafter simply referred to an "alloy powder") after forming a molded body by press molding.

BACKGROUND ART

Rare earth sintered magnets, such as neodymium-iron-boron sintered magnet (hereinafter referred to as an "R-T-B-based sintered magnet"), and samarium-cobalt sintered magnet, are widely used because of excellent magnetic characteristics.

Particularly, R-T-B-based sintered magnets are used for various applications, including various electric apparatuses, because of the affordable low price and the highest magnetic energy product among various known magnets.

Most of rare earth sintered magnets including the R-T-B-based sintered magnet are manufactured by melting (fusing) raw material, such as metal, casting the molten material into a mold to obtain an ingot, or performing a strip cast method to obtain a cast slab or the like, grinding the casted alloy material with a desired composition into alloy powder having a predetermined particle diameter (grain-size distribution), press-molding the alloy powder (press molding the powder in a magnetic field) to obtain a compact (green compact), and sintering and heat treated the compact.

In many cases, the process for obtaining the alloy powder from the casted material involves two grinding steps, namely, a coarse grinding step for grinding the casted material into coarse powder having a large particle diameter, and a fine grinding step for further grinding the coarse powder into powder having a desired particle diameter.

The procedure for press molding (press molding under a magnetic field) is classified into two methods. One method is dry molding which performs press-molding the obtained alloy powder with the powder being dried. The other is wet molding which is well known as, for example, HILOP (registered mark). The wet molding involves forming a slurry by dispersing alloy powder into an oil, supplying the alloy powder in the form of slurry into a mold, and press-molding the powder.

Even in use of either the wet molding or the dry molding, the thus-obtained molded body might come into contact with something in handling, including delivery, and might have its part broken to take a shape different from the desired shape or to cause cracks, which may generate a defective molded product.

In order not to increase the number of types of molds for use in press molding, in some cases, a molded body having the general-purpose size is formed by the press molding, and then cut into molded bodies each having a desired size. In this case, parts of the molded bodies having the general-purpose size might remain as a molded body having an insufficient size (hereinafter referred to as a "molded remnant").

The supply of the rare earth element for use in the rare earth sintered magnet is of increasing concern from the viewpoint of both the price and quantity as compared to the past. For this reason, the defective molded product and molded remnant as described above are requested to be recycled more effectively than ever before.

Patent Document 1 discloses that a molded remnant is mechanically squeezed into recycled alloy powder, which is mixed into a slurry for obtaining another molded body.

CONVENTIONAL ART DOCUMENTS

Patent Document

Patent Document 1: JP 2004-207578 A

SUMMARY OF INVENTION

Problems to be Solved by the Invention

However, when the recycled alloy powder is obtained by mechanically pressing the molded body as disclosed in Patent Document 1, the particle diameter of the recycled alloy powder obtained by grinding the alloy powder in mechanically squeezing the molded body might be small as compared to the state before forming the molded body (that is, the state in which casted material is ground into the alloy powder).

The particle diameter of the alloy powder largely affects the magnetic characteristics of the rare earth sintered magnet finally obtained, and the size of the magnet after sintering. For this reason, the amount of the recycled alloy powder to be added to the slurry is disadvantageously restricted to such a very small value that does not influence the magnetic characteristics and the size after the sintering.

In mechanically squeezing the molded body, the alloy powder might be oxidized. The large oxygen content of the alloy powder might degrade the magnetic characteristics of the thus-obtained rare earth sintered magnet.

Accordingly, it is an object of the present invention to provide a recycle method and apparatus for effectively obtaining a recycled alloy powder which is hardly oxidized and which has substantially the same particle diameter as that of alloy powder used for forming a molded body, by using the molded body formed by press molding in manufacturing a rare earth sintered magnet.

Means for Solving the Problems

According to a first aspect of the invention in the present application, a method for recycling a powder containing a rare earth element includes the steps of:

i) placing in an oil a molded body for a rare earth sintered magnet, the molded body comprising a powder containing a rare earth element;

ii) arranging the oil and at least a part of the molded body between a plurality of plate-like first crushing teeth opposed to each other and a plate-like second crushing tooth having at least its part positioned in between the adjacent first crushing teeth;

iii) rotating at least either one of the plurality of first crushing teeth and the second crushing tooth without contacting to each other such that the first crushing teeth and the second crushing tooth serve to change a part of the second crushing tooth positioned between the adjacent first crushing teeth.

In a second aspect of the invention according to the first aspect, after placing the molded body in the oil within a tank, the plurality of first crushing teeth and the second crushing tooth are inserted into the tank to thereby perform the steps ii) and iii).

In a third aspect of the invention according to the first or second aspect, the first crushing teeth are attached to a first support bar extending vertically from a rotary shaft, and the second crushing tooth is attached to a second support bar having its longitudinal direction disposed vertically with respect to the rotary shaft, so that the first crushing teeth are rotated by rotating the rotary shaft.

In a fourth aspect of the invention according to any one of the first to third aspects, the method further includes the step of, after the steps i) to iii), performing filtering for separation of crushed powder having substantially the same particle diameter as that of the powder containing the rare earth element used for forming the molded body.

According to a fifth aspect of the invention, a recycle apparatus for recycling a powder for a rare earth sintered magnet is adapted to crush a molded body for a rare earth sintered magnet including a powder containing a rare earth element, thereby producing a powder containing the rare earth element and having substantially the same particle diameter as that of a powder provided before molding the molded body. The recycle apparatus includes: a crusher including a plurality of plate-like first crushing teeth opposed to each other, and a plate-like second crushing tooth having at least its part movable between the adjacent first crushing teeth, at least either one of the plurality of first crushing teeth and the second crushing tooth being adapted to rotate without contact therebetween so as to change a part of the second crushing tooth positioned between the adjacent first crushing teeth; a movable tank for storing therein the molded body and an oil; a lifting and lowering unit into which the crusher is inserted from an opening of the tank; and a filter unit for separating the powder containing the rare earth element and having a predetermined particle diameter, from the crushed molded body placed in the oil fed from the tank.

In a sixth aspect of the invention according to the fifth aspect, the first crushing teeth is attached to a first support bar extending vertically from a rotary shaft, and the second crushing tooth is attached to a second support bar having its longitudinal direction disposed vertically with respect to the rotary shaft, so that the first crushing teeth are rotated by rotating the rotary shaft.

In a seventh aspect of the invention according to the sixth aspect, the recycle apparatus further includes: a third support bar located under the first support bar and extending vertically from the rotary shaft; and a plurality of plate-like third crushing teeth opposed to each other and attached to the third support bar, wherein at least apart of the second crushing tooth is movable between the adjacent third crushing teeth, and wherein the third crushing teeth are rotated by rotating the rotary shaft to change a part of the second crushing teeth positioned between the adjacent third crushing teeth.

Advantages Effects of Invention

The invention of the present application provides a recycle method and apparatus which can effectively obtain a recycled alloy powder which is hardly oxidized and which has substantially the same particle diameter as that of alloy powder used for forming a molded body, by use of the molded body formed by press molding in manufacturing a rare earth sintered magnet.

EMBODIMENT FOR CARRYING OUT THE INVENTION

Figure 1:
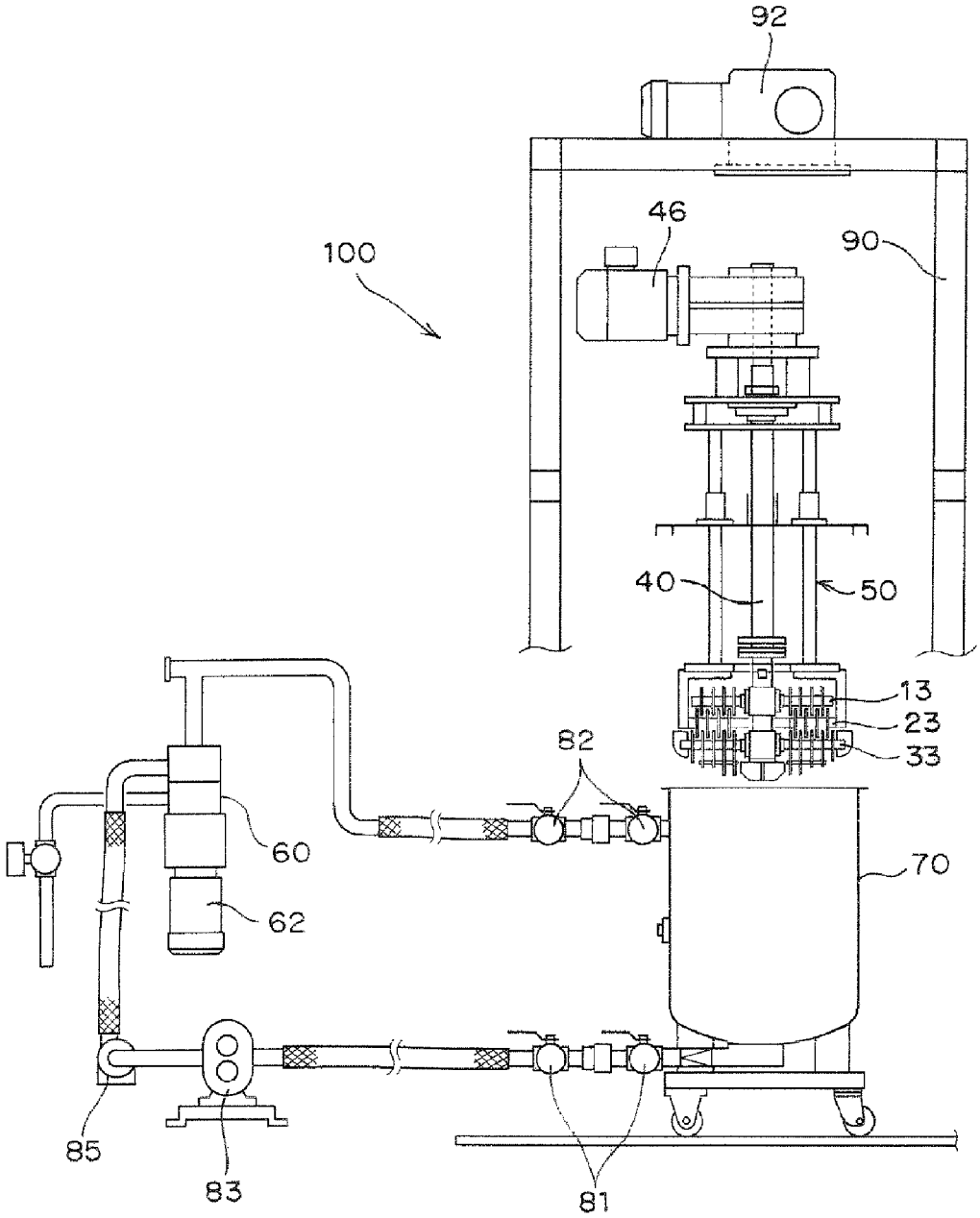
FIG. 1 is a side view of a recycle apparatus 100 for alloy powder with a crusher 50 positioned outside a tank 70 according to the invention of the present application.

Preferred embodiments of the invention will be described in detail below based on the accompanying drawings. In the description below, if necessary, the terms indicative of the specific direction or position (for example, "upper", "lower", "right", "left", and other words including these words) are used for easy understanding of the invention with reference to the figures. The meanings of the terms do not limit the technical range of the invention. The same parts or members are designated by the same reference numerals throughout the drawings.

As mentioned above, the invention of the present application has an object of recycling an alloy powder (alloy powder for a rare earth sintered magnet) that is substantially the same as that before molding, from a molded body, such as a defective molded product or molded remnant without substantially changing its particle diameter.

This means that the obtained molded body is crushed without being ground.

Now, the phrases "without substantially changing its particle diameter", "crush the molded body", and "grind the molded body" as used herein will be defined as follows.

The phrase "without substantially changing its particle diameter" as used herein means that a ratio of variations in particle diameter of the powder of interest (alloy powder for use to produce a molded body) determined D50 is within ±100. More specifically, this means that a difference between a D50 value of the alloy powder used for producing the molded body and another D50 value of the alloy powder obtained by recycling the molded body is within ±10% of the D50 value of the alloy powder used for producing the molded body.

The term "D50" means the particle diameter of particles when the volumes of particles of interest for measurement are accumulated in order of increasing volume up to 50% of the volume of the powder of interest for measurement. The measurement of particle diameter distribution of particles of the powder of interest to be measured for determination of D50 value can be determined by measuring the particle diameter of the particles using laser diffraction in conformity to International Standard ISO13320-1.

The phrase "grind a molded body" as used in the specification means that a molded body is subjected to external force to produce alloy powder, so that the particle diameter of the thus-obtained powder is different from that of the alloy powder used for producing the molded body.

That is, the alloy powder forming the molded body is ground and worn away by applying the relatively strong external force to the molded body, which results in a decrease in particle diameter of the alloy powder obtained by grinding.

The phrase "crush a molded body" as used in the specification means that the external force is applied to the molded body to thereby produce the alloy powder without substantially changing its particle diameter.

That is, the external force applied to the molded body in crushing (or disintegrating) has appropriate strength, specifically, the strength enough to crush or disintegrate the molded body to obtain the alloy power, but not enough to grind or wear the obtained alloy powder.

The inventors of the present application have been dedicated to studying about methods for crushing the molded body (that is, only crushing and not grinding) while suppressing the oxidization of the alloy powder obtained by the crushing.

As a result, the inventors of the present application have found that the object of the invention can be achieved by crushing by use of a crusher including a plurality of first plate-shaped crushing teeth opposed to each other and a second plate-shaped crushing tooth disposed between the first crushing teeth. The crusher is configured to allow at least a part of the molded body and oil to go into a space between the first and second crushing teeth. Specifically, by using the crusher, the crushing is performed by rotating at least one of the first and second crushing teeth without the contact between the first and second crushing teeth.

In this way, the thus-obtained alloy powder is found to have substantially the same particle diameter as that before the molding, which means the alloy powder is obtained by sufficiently crushing the molded body. Also, the crushing process can be performed in oil to sufficiently suppress the oxidization.

The thus-obtained alloy powder for the rare earth magnet is being mixed with used oil, that is, in the form of slurry, and thus can be used as the slurry for use in the wet molding method. Alternatively, the thus-obtained slurry is dried to form a dried alloy powder and the dried alloy powder can be used for the dry molding method.

Now, the method and apparatus according to the invention of the present application will be described in detail.

FIG. 1 shows a side view of a recycle apparatus 100 for alloy powder with a crusher 50 positioned outside a tank 70 according to the invention of the present application.

Figure 2:
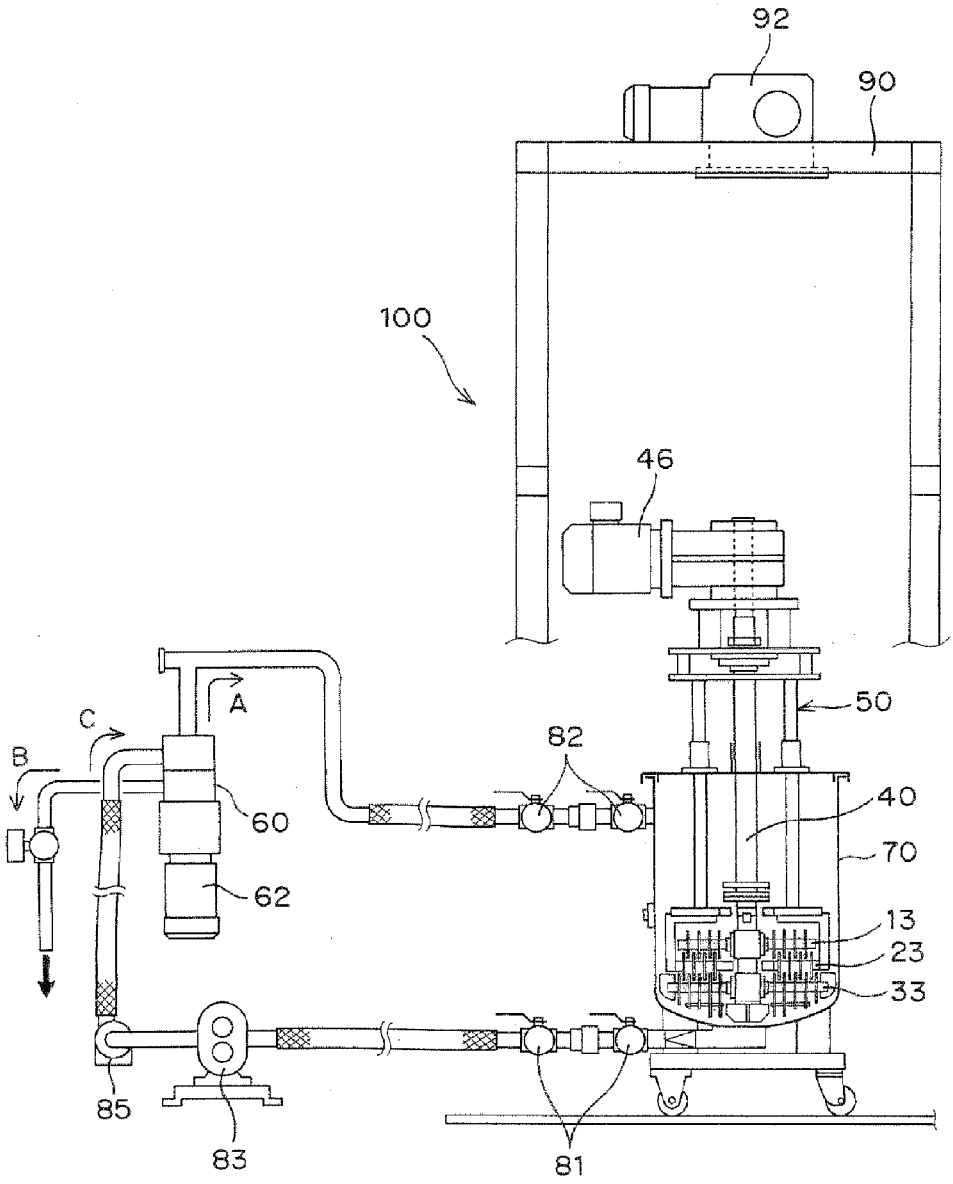
FIG. 2 is a side view of the recycle apparatus 100 for alloy powder with the crusher 50 inserted into the tank 70 according to the invention of the present application.

FIG. 2 shows a side view of the recycle apparatus 100 for alloy powder with the crusher 50 inserted into the tank 70 according to the invention of the present application.

Figure 3:
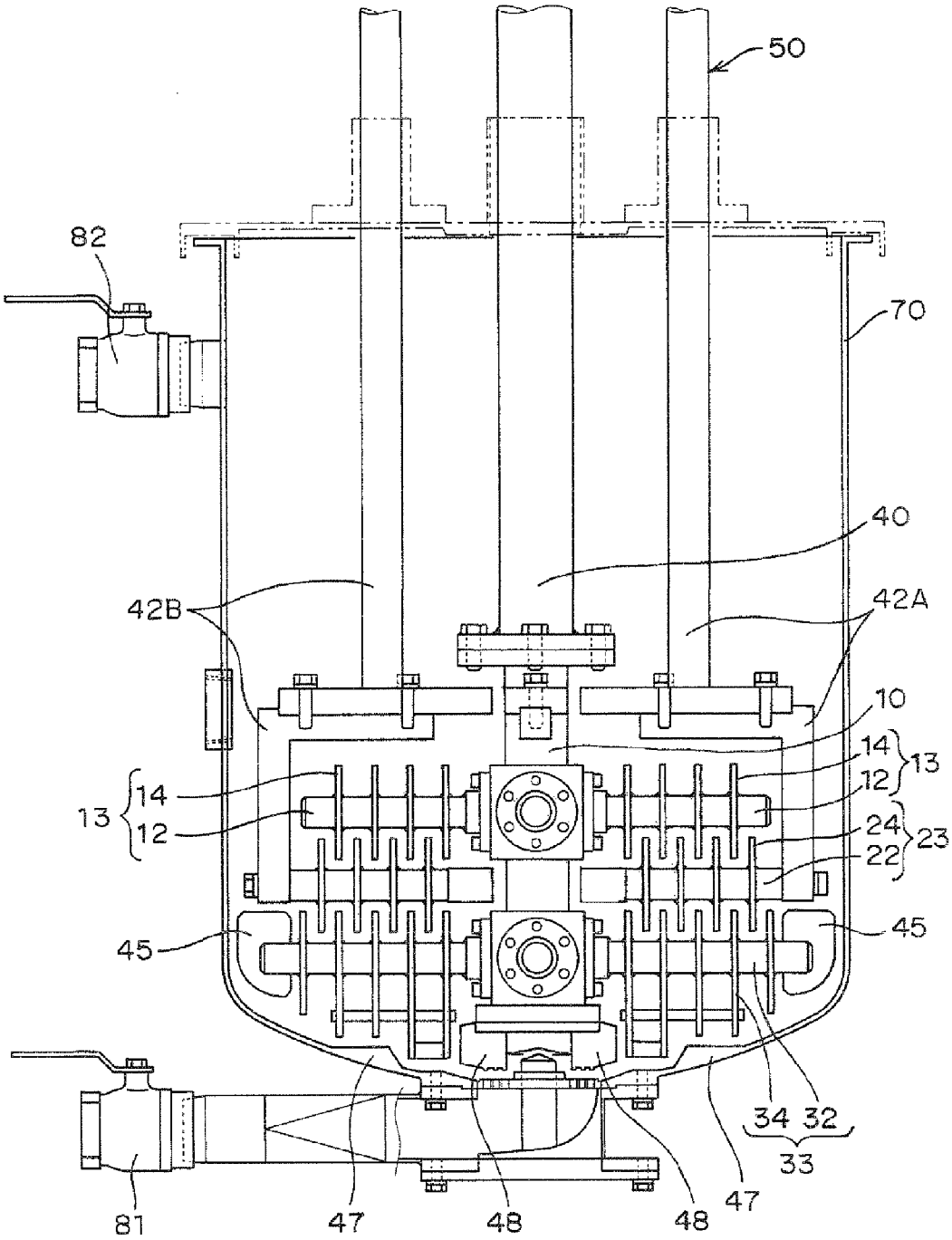
FIG. 3 is a side view showing the details of the crusher 50.

FIG. 3 shows a side view of the details of the crusher 50.

The recycling apparatus 100 includes the tank 70, the crusher 50, the filter unit 60, and a lifting and lowering unit 90.

The following will refer to the details of the recycle apparatus 100.

(1) Tank

The tank 70 has an oil (not shown) fed thereinto, and a molded body is placed in the oil. The oil for use may be mineral oil and/or synthetic oil, and preferably the same oil as that used for a slurry in the wet molding method. In the recycle apparatus 100, the alloy powder recycled is obtained in the form of slurry. When the slurry containing the recycled powder uses the same kind of oil as that used for another slurry in the wet molding, the obtained slurry can also be appropriately used as it is as a slurry for obtaining a new molded body by the wet molding.

The term "slurry" as used herein means a fluid made of a mixture of solid particles and a liquid, in which the solid particles are suspended.

The molded bodies placed in the tank 70 can include, for example, the above-mentioned defective molded product and molded remnant. The molded bodies are not limited thereto, and may include various modified bodies, including excess good molded.

The molded body may be one obtained by the dry molding method, or one obtained by the wet molding method, but preferably one obtained by the wet molding method. The molded body obtained by the dry molding method has its surface exposed to air, which promotes oxidation of the molded body itself after molding, resulting in an increase in amount of oxygen of the recycled alloy powder in some cases. In order to avoid this situation, the measurements against oxidation, including dropping the molded body in oil quickly after the molding process, are sometimes required. On the other hand, the molded body obtained by the wet molding method has its molded surface covered with oil of the used slurry, which protects the molded body from oxidation. The use of such a molded body can easily control the oxygen content of the recycled alloy powder obtained to substantially the same level as the oxygen content of the alloy powder before the molding.

The tank 70 is preferably movable, for example, by wheels as shown in FIGS. 1 and 2. Thus, for example, the tank 70 in which oil is charged is placed near a press machine for performing the pressing process. As soon as a defected molded product is formed in the pressing step, the defected molded product is dropped in the tank 70, and thus can be held in the oil, which can surely suppress the oxidation of the defective product.

Likewise, the tank 70 is placed near a cutting machine for cutting the molded body in a desired shape. As soon as the molded remnant is generated into the cutting step, the molded remnant is dropped in the tank 70, so that the molded remnant can be held in the oil, which can surely suppress the oxidation of the defective product.

When some amounts of defective molded products or molded remnants are stored in the tank 70, the tank 70 is conveyed to under the crusher 50 as shown in FIG. 1. Subsequently, as shown in FIG. 2, the crusher 50 is inserted into the tank 70 where the crushing can be performed.

Such a preferable structure can have the effect of surely preventing the oxidation of the defective molded product or molded remnant. There is no necessity of moving the defective molded product or molded remnant from a storage container for storing the molded product or remnant to the tank in order to perform the crushing process. This method enables effective crushing with high productivity.

(2) Crusher

The crusher 50 includes a plurality of first plate-shaped crushing teeth 14 opposed to each other and second plate-shaped crushing teeth 24 each disposed between the adjacent first crushing teeth. At least either one of the first and second crushing teeth 14 and 24 can be configured to rotate (or move) without being in contact with each other (such that the first crushing teeth 14 do not come in contact with the second crushing teeth 24).

Figure 4:
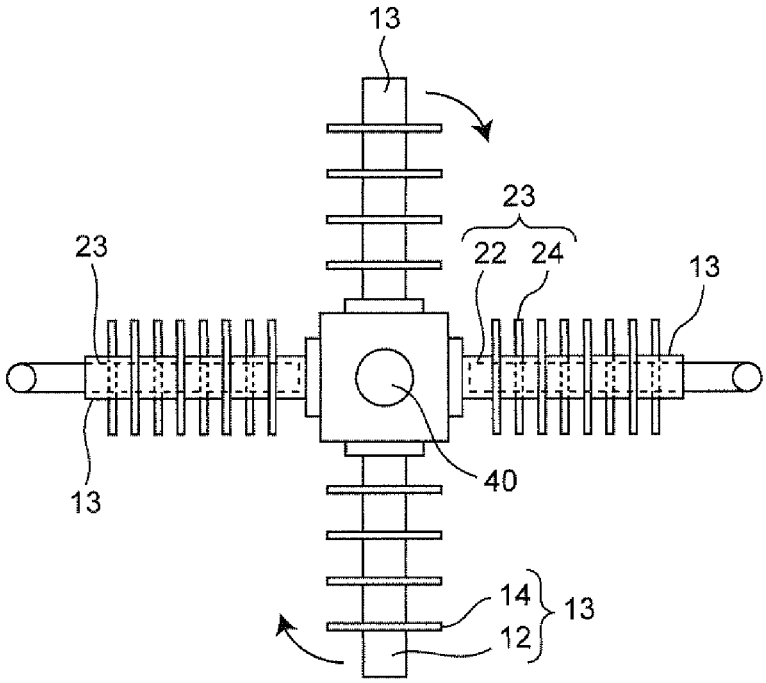
FIG. 4 is a top view showing the arrangement of first crushing members 13 and second crushing members 23.

FIG. 4 shows a top view of the arrangement of the first crushing members 13 and second crushing members 23 to be described later.

In the embodiments shown in FIGS. 3 and 4, a plurality of (four, as shown in FIG. 3) first crushing members 13 are disposed. The first crushing member 13 includes a first support bar 12, and a plurality of (four, as shown in FIG. 3) plate-like first crushing teeth 14 attached to the first support bar 12. Referring to FIGS. 3 and 4, the first support bar 12 penetrates the substantially center of each of the first crushing teeth 14. As shown in FIG. 4, the first crushing member 13 is attached around a rotary shaft 40 every 90°. The four first support bars 12 extend vertically from the rotary shaft 40. The rotary shaft 40 is rotatable, which allows the four first crushing members 13 to be rotated in the direction of arrow shown in FIG. 4 (and/or the opposite direction to the direction of arrow).

Likewise, each of second crushing members 23 includes a second support bar 22, and a plurality of (four as shown in FIG. 3) plate-like second crushing teeth 24 attached to the second support bar 22. Referring to FIGS. 3 and 4, the second support bar 22 penetrates the substantially center of each of the second crushing teeth 24. The crusher 50 includes the two second crushing members 23. Each second crushing member 23 is fixed by a fixing member 42A or 42B such that the second support bars 22 are arranged on the same straight line under the first support bars 12.

Both two second support bars are arranged vertically with respect to the rotary shaft 40.

As shown in FIGS. 3 and 4, every time the rotary shaft 40 rotates to cause the first crushing member 13 to rotate by 90°, the volume of parts of the second crushing teeth 24 (or superimposed area to be described later) positioned between the adjacent first crushing teeth 14 is maximized.

This will be described in detail below.

In the states as shown in FIGS. 3 and 4, the volume of the parts of the second crushing teeth 24 positioned between the adjacent first crushing teeth 14 (or a projected area viewed in the direction parallel to the second support bar 22 at the part of the second crushing tooth 24 located between the adjacent first crushing teeth 14, which projected area is hereinafter referred to as a "superimposed area") is maximized.

When the rotary shaft 40 rotates to cause the first crushing teeth 14 attached to the first support bars 12 to rotate in the direction of arrow shown in FIG. 4, the superimposed area is decreased, that is, the part of the second crushing tooth 24 positioned between the adjacent first crushing teeth 14 is changed, which results in no second crushing tooth 24 positioned between the adjacent first crushing teeth 14 (leading to no superimposed area). When the rotation angle approaches 90°, the first crushing teeth 14 of another first crushing member 13 is getting close to the second crushing teeth to generate a part of each of the second crushing teeth 24 positioned between the adjacent first crushing teeth 14. Then, the superimposed area is gradually increased, and becomes maximum at the rotation angle of 90°. Thereafter, when the rotation angle is further increased, the superimposed area is decreased (that is, the part of the second crushing tooth 24 positioned between the adjacent first crushing teeth 14 is changed). In this way, while the rotary shaft 40 rotates, the state of no superimposed area, the state of increasing the superimposed area, and the state of decreasing the superimposed area are repeatedly taken in turn.

Preferably, as shown in FIG. 3, in addition to or instead of the first crushing members 13, four third crushing members 33 are arranged. Each third crushing member 33 includes a third support bar 32, and a plurality of plate-like third crushing teeth 34 attached to the third support bar 32 (as shown in FIG. 3, five third crushing teeth 34 are arranged at one third support bar 32). Like the first crushing members 13, the third crushing member 33 is attached around the rotary shaft 40 every 90°. The third support bars 32 extend vertically from the rotary shaft 40. The third support bar 32 is positioned below the second support bar 22 (that is, below the first support bar 12) as shown in FIG. 3.

Like the first crushing members 13, every time the rotary shaft 40 rotates to cause the third crushing members 33 to rotate by 90°, the volume of each of parts of the second crushing teeth 24 (or superimposed area to be described later) positioned between the adjacent third crushing teeth 34 is maximized.

In the state shown in FIG. 3, the superimposed area of the part of the second crushing tooth 24 between the adjacent third crushing teeth 34 (in this case, the projected area viewed from the direction parallel to the third support bar 32) is maximized.

When the rotary shaft 40 rotates to cause the third crushing teeth 34 attached to the third support bar 32 to rotate, the superimposed area is decreased, that is, the part of each of the second crushing teeth 24 positioned between the adjacent third crushing teeth 34 is changed, which results in no second crushing tooth 24 positioned between the adjacent third crushing teeth 34 (leading to no superimposed area). When the rotation angle approaches 90°, the third crushing teeth 34 of another third crushing member 33 is getting close to the second crushing teeth 24 to generate parts of the second crushing teeth 24 positioned between the adjacent third crushing teeth 34. Then, the superimposed area is gradually increased to become maximum. Thereafter, when the rotation angle is further increased, the superimposed area is decreased (that is, the parts of the second crushing tooth 24 positioned between the adjacent third crushing teeth 34 are changed). In this way, the state of no superimposed area, the state of increasing the superimposed area, and the state of decreasing the superimposed area are repeatedly taken in turn.

Even though the rotary shaft 40 rotates, the first crushing teeth 14 are designed not to come into contact with the second crushing teeth 24. Likewise, even though the rotary shaft 40 rotates, the third crushing teeth 34 are designed not to come into contact with the second crushing teeth 24.

As mentioned in the above description, the first crushing member 13 and the third crushing member 33 connected to the rotary shaft 40 are rotatable around the rotary shaft 40 while the second crushing members 23 are fixed. However, the second crushing members 23 may also be rotatable. For example, the second crushing members 23 can be coaxial (or concentric) with respect to the first crushing member 13, and are rotatable in the direction opposite to that of the first crushing member 13.

In the embodiments shown in FIGS. 3 and 4, the first crushing members 13 and the third crushing members 33 rotate around the rotary shaft 40 as a rotational axis to move without coming into contact with the second crushing member 23. However, the invention is not limited thereto.

The first crushing teeth 14 and the second crushing teeth 24 can have any structure as long as at least either one of the teeth 14 and 24 rotate without contact between the first and second teeth 14 and 24 such that the part of each of the second crushing teeth 24 positioned between the adjacent first crushing teeth 14 is changed.

With this arrangement, for example, instead of or in addition to the rotation of the first crushing teeth 14 (and the third crushing teeth 34) around the rotary shaft 40 as the rotational axis as mentioned above, the second crushing teeth 24 may rotate around the second support bar 22 as the rotational shaft.

In the latter case, that is, when the first crushing teeth 14 (and the third crushing teeth 34) rotate around the rotary shaft 40 as the rotational axis and the second crushing teeth 24 rotate around the second support bar 22 as the rotational axis, the molded body and the crushed molded body can be more effectively stirred in the tank 70, which can effectively perform the crush.

The first crushing teeth 14 placed at the same first support bar 12 are preferably arranged in parallel to each other. Likewise, the second crushing teeth 24 placed at the same second support bar 22 are preferably arranged in parallel to each other. Likewise, the third crushing teeth 34 placed at the same third support bar 32 are preferably arranged in parallel to each other. The first crushing teeth 14, the second crushing teeth 24, and the third crushing teeth 34 may have any shape as long as they are formed in the plate-like shape, for example, a disk-like shape, a polygonal shape, such as a quadrilateral shape, and an ellipsoidal shape. Each of the first crushing teeth 14, the second crushing teeth 24, and the third crushing teeth 34 may have a through hole or recessed portion penetrating from one surface to the other surface.

The distance between the two adjacent first crushing teeth 14 may be appropriately selected according to the size of a defective molded product or molded remnant to be mainly crushed. For example, in the recycle apparatus shown in FIGS. 1 to 4, the distance between the first crushing teeth may be about 25 mm. The same goes for the distance between the two adjacent second crushing teeth 24 and/or two adjacent third crushing teeth 34. Thus, when the rotary shaft 40 rotates to cause the second crushing teeth 24 to be located between the two adjacent first crushing teeth 14, the distance between the first crushing tooth 14 and the second crushing tooth 24 may be about 10 mm. When each of the second crushing teeth 24 is located between the two adjacent third crushing teeth 34, the distance between the second crushing tooth and the third crushing tooth may also be about 10 mm.

The crusher 50 with such an arrangement is movable vertically by the lifting and lowering unit 90. The lifting and lowering unit 90 can lift and lower the crusher 50, for example, using wires (not shown) connected to a motor 92.

Next, the procedure for crushing the molded body placed in the oil within the tank 70 by the crusher 50 will be described below.

As shown in FIG. 1, the crusher 50 is first raised to above the tank 70 by the lifting and lowering unit 90. Then, the crusher 50 is lowered by the lifting and lowering unit 90 to be inserted into the tank 70. At this time, the rotary shaft 40 is rotated by the motor 46, so that the first crushing members 13 and the third crushing members 33 (if provided) rotate around the rotary shaft 40 as the rotational axis.

The crusher 50 is brought into contact with the molded body (oil and molded body not shown) in the oil within the tank 70. When the crusher 50 is further descended, the molded body is roughly crushed by the first crushing members 13 and the second crushing members 23.

The descending speed of the crusher 50 is preferably selected according to the capacity of the tank 70, the volume of the molded bodies accommodated in the tank 70, and the size of the molded body. The crusher 50 may be continuously descended or discontinuously descended.

The term "roughly crush" as used herein means the state of roughly crushing, that is, the state of crushing the molded body into particles having a larger particle diameter (agglomeration of alloy particles) than that of the alloy powder for use in molding.

In order to effectively perform the rough crushing process, the third crushing members 33 are preferably provided. The lower end of the descending crusher 50 is provided with the rotating third crushing members 33, so that the molded body is roughly crushed in a shorter time. Instead of providing the third crushing members 33 together with the first crushing members 13, the third crushing members 33 can be provided in place of the first crushing members to effectively perform the rough crushing (that is, without providing the first crushing members 13 described in FIG. 3, the crushing members 33 shown in FIG. 3 (crushing member disposed under the second crushing member 23) are used in place of the first crushing member in another embodiment).

When the crusher 50 reaches the lowermost point as shown in FIG. 2, the lifting and lowering unit 90 is stopped, and then the crusher 50 remains at the lowermost point. The motor 46, however, continues rotating the rotary shaft 40, so that the first crushing members 13 and the third crushing members 33 continuously rotates around the rotary shaft 40 as the rotational axis.

The revolution speed of each of the first crushing members 13 and the third crushing members 33, that is, the rotating speed of the rotary shaft 40 is preferably selected according to the capacity of the tank 70, the volume of the molded bodies contained in the tank 70, and the size of each molded body, and is, for example, in a range of about 1 to 200 rpm.

The rotational direction of the first crushing member 13 and the third crushing member 33, that is, the rotational direction of the rotary shaft 40 may be constant, or reversed every time a predetermined time has elapsed.

The rotating speed of the rotary shaft 40 may be constant or changed. For example, as the crusher 50 is descending, the rotating speed of the crusher is increased. Alternatively, the crusher 50 may increase its rotating speed while being kept in the lowermost position, or the crusher 50 may increase its rotating speed when being lifted.

The first crushing member 13 and the third crushing member 33 are adapted to rotate for an appropriate time, so that the grinding hardly be performed but the rough crushing is performed and the further crushing proceeds in the tank 70.

The use of the crusher 50 hardly perform the grinding process, but can surely promote the crushing in the following mechanism, which is assumed based on the findings obtained so far by the inventors of the present application.

It is noted that the assumed mechanism does not intend to restrict the scope of the invention of the present application.

The molded body is roughly crushed to gradually become smaller. Also by the stirring effect caused by the rotation of the first and third crushing members 13 and 33, the molded body which becomes sufficiently small (or is sufficiently roughly crushed) passes through between the first crushing teeth 14 and the second crushing teeth 24.

The first crushing teeth 14 rotate with the rotary shaft 40 as the rotational shaft as mentioned above (that is, the part of the second crushing tooth 24 positioned between the adjacent first crushing teeth 14 is changing (in other words, which part of the second crushing tooth 24 is positioned between the adjacent first crushing teeth 14 is changing)). This means that the first crushing teeth 14 move substantially in parallel to the fixed second crushing teeth 24. That is, in the embodiments shown in FIGS. 3 and 4, every time the first crushing member 13 rotates by about 90°, the fixed second crushing teeth 24 are positioned between the opposed first crushing teeth 14, so that the mixture of oil and the molded bodies roughly crushed intervenes in between the first crushing teeth 14 and the second crushing teeth 24. In this state, when the first crushing teeth 14 rotates, that is, rotates substantially in parallel to the second crushing teeth 24, a shear force is applied to the molded body roughly crushed via the oil.

Even though the distance between the first crushing tooth 14 and the second crushing tooth 24 is large as compared to the diameter of the particle of the alloy powder to be recycled (for example, having a D50 of about 2 to 10 μm), the shear force is applied to the oil, so that the necessary shear force can be applied to the molded body roughly crushed (molded body whose particle diameter approaches the particle diameter of the alloy powder to be recycled).

The shear force is strong enough to crush or disintegrate the molded body roughly crushed, but is not strong enough to grind the alloy powder obtained by the crushing. As a result, the molded body hardly undergoes the grinding process, but the crushing of the molded body progresses.

In use of the third crushing member 33, the same crushing mechanism can be applied to between the third crushing teeth 34 and the second crushing teeth 24.

In order to enhance the stirring within the tank 70, especially, in the lower portion of the tank 70, and to effectively supply the molded body roughly crushed to between the first and second crushing teeth 14 and 24, or between the third and second crushing teeth 34 and 24, one or more of the following is preferably performed as shown in FIG. 3: (1) provision of fins 47 at the bottom of the tank; (2) provision of fins 45 at the end of the third support bar 32; and (3) provision of rotary wings 48 at the lower end of the rotary shaft 40.

(3) Filter Unit

When the crushing is proceeded using the crusher 50 as mentioned above, the oil within the tank 70 contains the mixture of the molded bodies crushed (alloy powder of interest) and the molded body roughly crushed.

For this reason, preferably, the alloy powder of the molded body recycled is separated as the slurry using the filter unit 60, and then the remaining molded body roughly crushed is further crushed by the crusher 50.

As such a filter unit 60, various types of filter apparatuses may be used which can separate particles in the slurry according to its particle diameter.

Figure 5:
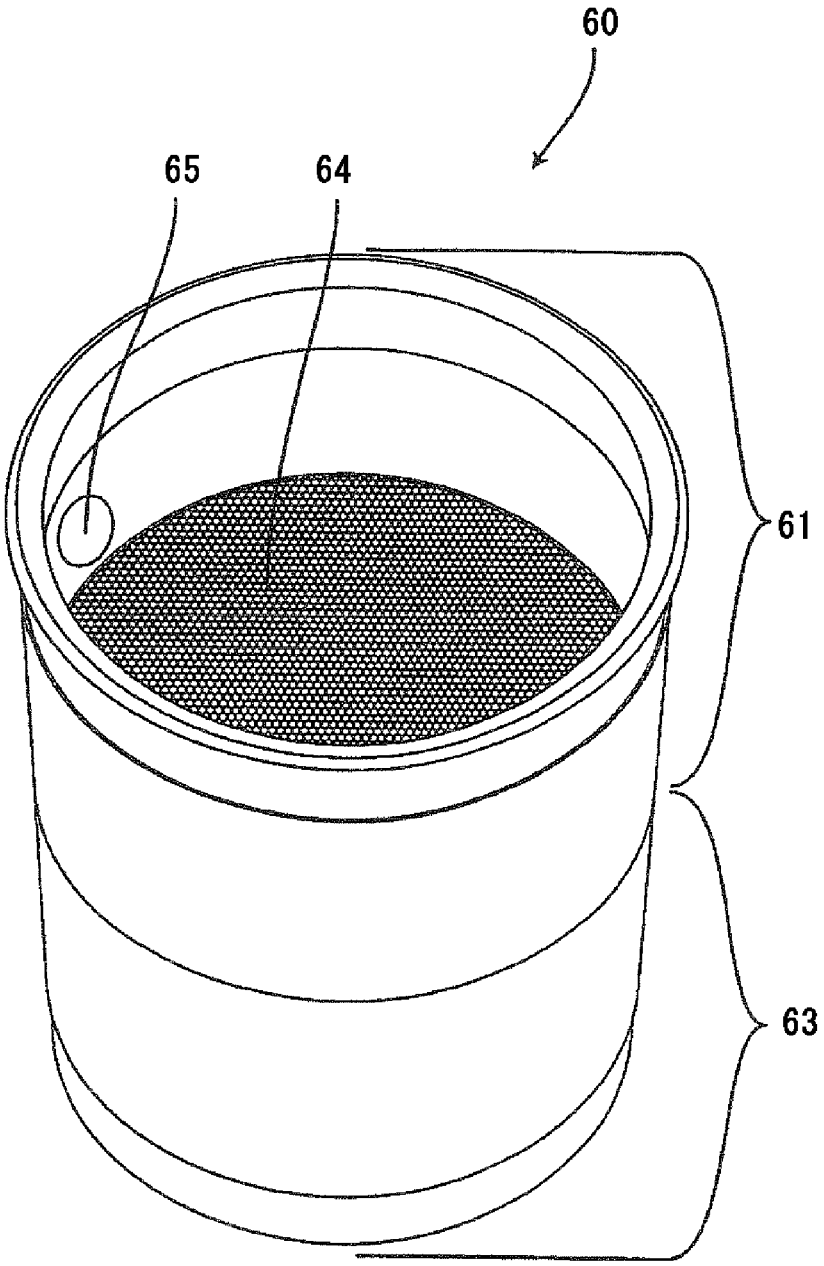
FIG. 5 is a perspective view exemplifying a filter apparatus 60.

FIG. 5 shows a perspective view of the filter unit 60.

The filter unit 60 shown in FIG. 5 is comprised of a first filter portion 61 located at upper side and a second filter portion 63 located at lower side. The first filter portion 61 and the second filter portion 63 are partitioned by a punching metal 64 provided at lower side of the first filter portion 61. The punching metal 64 serves as a first filter for preventing the invasion of foreign matter or large molded body into a second filter portion.

The first filter portion 61 has on its side an opening 65 through which the molded body crushed (alloy powder of interest) and the mixture of the oil and the molded bodies roughly crushed can be received.

Figure 6:
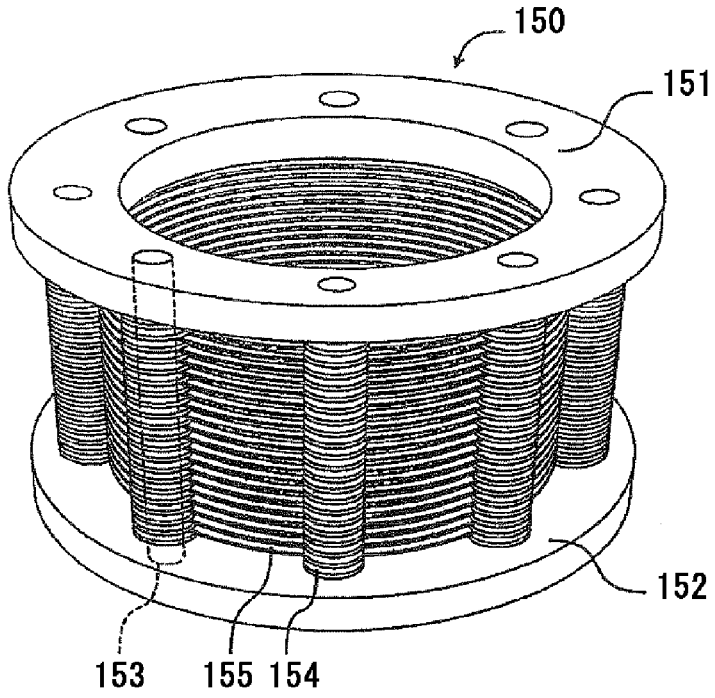
FIG. 6 is a perspective view showing a second filter (cylindrical filter) 150 disposed in a second filter portion 63.

FIG. 6 shows a perspective view of a second filter (cylindrical filter) 150 disposed in the second filter portion 63. The second filter 150 includes disks 155 for the filter stacked on each other with a predetermined spacing therebetween by use of support rods 153 disposed between filter bases 151 and 152, and disks (spacers) 154 for distance adjustment arranged at the support rods at equal intervals. The distance between the adjacent disks 155 for the filter can be set larger than the particle diameter of the alloy powder before molding of the defective molded product or molded remnant to be crushed. That is, as will be described later, the mixture of the oil and the molded bodies roughly crushed circulates through a cycle from the tank 70 to the filter unit 60 and then to the tank 70 (tank 70→filter unit 60→tank 70) to be crushed into the alloy powder. In passing through between the adjacent disks 155 for the filter, the particles of the molded body come to have the particle diameter substantially equal to that of the alloy powder before molding. Thus, the distance between the adjacent disks 155 for the filters preferably has only to have such a size that can remove the foreign matter not removed by the first filter 61, and thus can be appropriately set according to the size or amount of the particles of the molded body to be crushed, or the size of foreign matter mixed.

As shown in FIG. 6, the bases 151 and 152 and the disks 155 for the filter have through holes in the center, and the second filter 150 has a space in the center.

Figure 7:
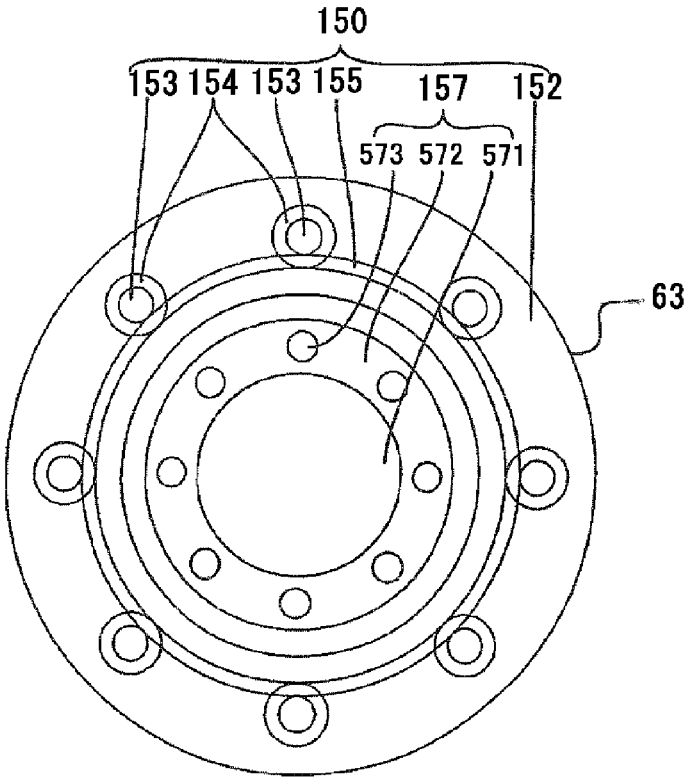
FIG. 7 is a top view showing the internal structure of the second filter 63, while showing an explanatory diagram of the state of removal of a base 151 from the second filter 150.

FIG. 7 is a top view of the internal structure of the second filter 63, while showing an explanatory diagram of the state of removal of the base 151 from the second filter 150.

As shown in FIG. 7, inside the second filter portion 63, the base 152 of the second filter 150 is fitted into the inner surface of the wall of the filter portion 63. A rotor 157 is disposed in the second filter 150. The rotor will be described in detail later. The rotor 157 rotates while being driven using the motor 62 (see FIG. 2) to apply a centrifugal force to the molded bodies (alloy powder of interest) crushed and the mixture of the oil and the molded bodies roughly crushed, through the punch metal 64.

The molded body already crushed (alloy powder) that can pass through the gap between the disks 155 for the filter is discharged to the outside of the second filter 150 with the oil together as a slurry.

In contrast, the molded body roughly crushed and which cannot pass through the gap between the disks 155 for the filter remains inside the second filter 150 without being discharged to the outside of the filter 150.

Figure 8:
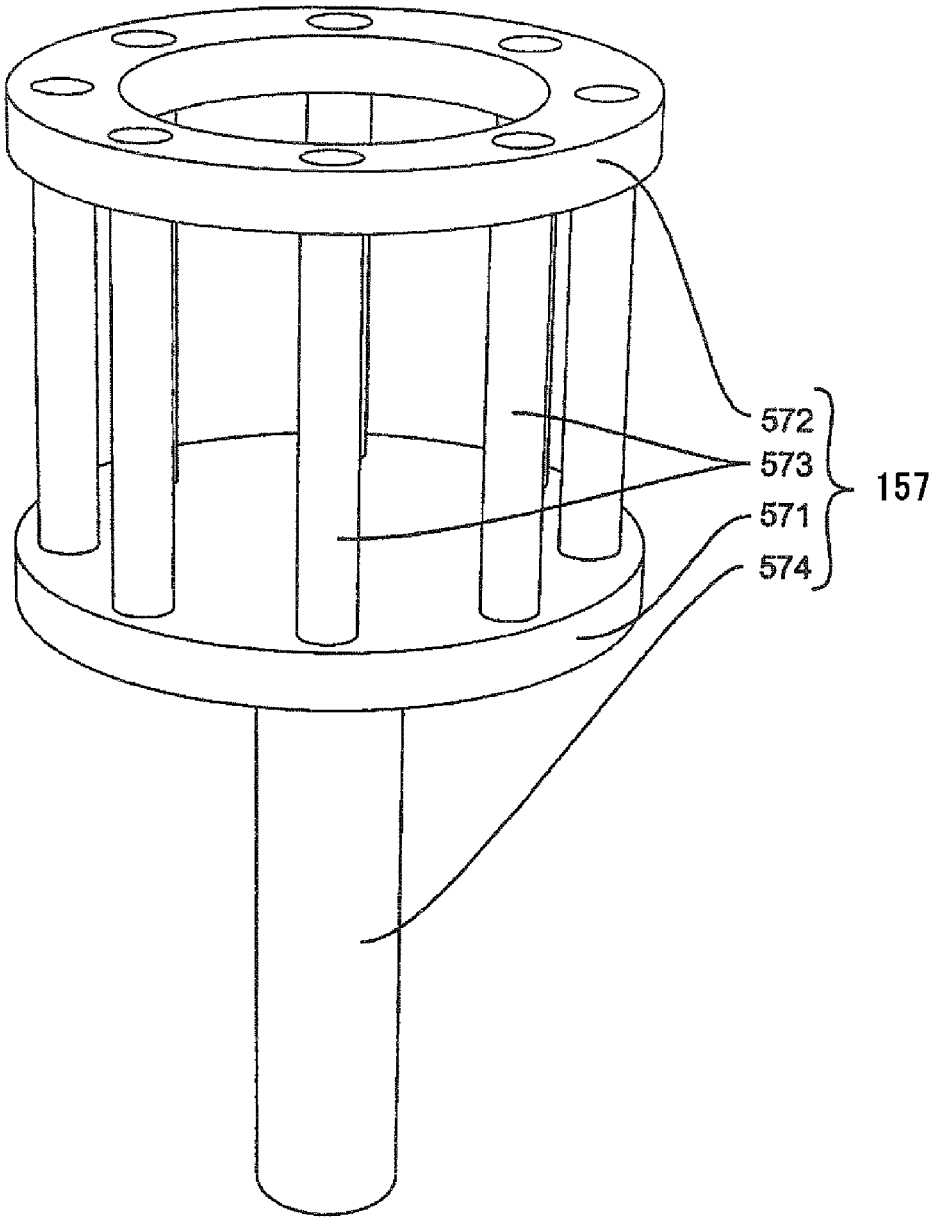
FIG. 8 is a perspective view showing the detailed structure of a rotor 157.

FIG. 8 shows a perspective view of the detailed structure of the rotor 157. The rotor 157 includes a disk 571, a ring-like flat plate (disk having a through hole at its center) 572, and a plurality of cylinders 573. The disk 571 is positioned on the base 152 side of the second filter 150 as shown in FIG. 6. The rotor 157 includes a rotary shaft 574 connected to the motor 62. The rotor 157 rotates by the motor 62.

The following will refer to the procedure for separating the molded body crushed (that is, recycled alloy powder for the rare earth sintered magnet) as the slurry by use of the filter unit 60.

As mentioned above, the crusher 50 is used to promote the crushing, and then valves 81 and 82 connected to the tank 70 and the filter unit 60 are opened at the appropriate timing when the molded bodies crushed (alloy powder of interest) and the molded bodies roughly crushed are mixed together in the oil within the tank 70. The use of the pump 83 allows the molded bodies crushed in the tank 70 (alloy powder of interest), and the mixture of the oil and the molded bodies roughly crushed to move through the valve 81 in the direction of arrow C shown in FIG. 2 and then to be introduced into the filter unit 60.

The alloy powder (molded body crushed) and the mixture of the oil and the molded bodies roughly crushed are introduced from the opening 65 on the side surface of the filter unit 60 into the first filter portion 61 of the filter unit 60, and passes through the punching metal 64 with foreign matter removed therefrom to enter the second filter portion 63.

The alloy powder and the mixture of the oil and the molded bodies roughly crushed which enter the second filter portion 63 receive the centrifugal force induced by the rotor 157 rotated by the motor 62. Then, the alloy powder (molded body already crushed) that can pass through the gap between the disks 155 for the filter is discharged to the outside of the second filter 150 as the slurry. The discharged slurry moves along a route represented by the arrow B shown in FIG. 2 and is then recovered.

In contrast, the molded body roughly crushed cannot pass through the gap between the disks 155 for the filter, and thus cannot be discharged to the outside of the second filter 150. Thus, the mixture of the oil and the molded bodies roughly crushed moves from the filter unit 60 along the direction of the arrow A shown in FIG. 2, and returns to the tank 70 through the valve 82. Then, the mixture is roughly crushed and/or crushed by the crusher 50 again.

In this way, the mixture of the oil and the molded bodies roughly crushed circulates through the cycle from the tank 70 to the valve 81, the pump 83, the filter unit 60, the valve 82, and then tank 70 in that order (tank 70→valve 81→pump 83→filter unit 60→valve 82→tank 70) until the alloy powder is obtained after the crush.

In order to effectively crush the molded body, for example, as shown in FIG. 2, an auxiliary crusher 85 may be provided on the upstream side of the filter unit 60.

The provision of the auxiliary crusher 85 crushes a part of the molded body roughly crushed even outside the tank 70 during the above circulation, which can improve the efficiency of the crushing.

Figure 9:
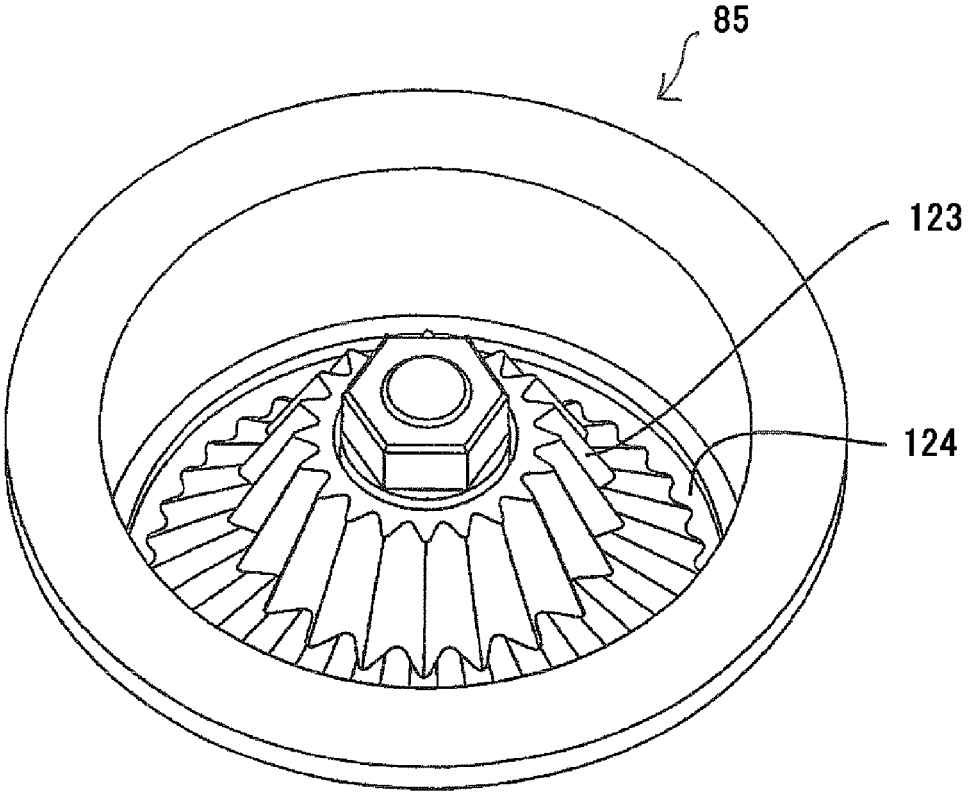
FIG. 9 is a perspective view exemplifying the structure of an auxiliary crusher 85.

FIG. 9 is a perspective view exemplifying the structure of the auxiliary crusher 85. The auxiliary crusher 85 includes gear-like crushing teeth 123, which include two kinds of teeth with different angles. The gear-like crushing teeth 123 are rotated by the motor. The rotation of the gear-like crushing teeth 123 crushes the part of the molded body roughly crushed into the alloy powder.

The alloy powder and the mixture of oil and molded bodies roughly crushed which are introduced from the above side shown in FIG. 9 into the auxiliary crusher 85 are discharged to the outside of the auxiliary crusher 85 via a space 124 provided at the side surface of the gear-like crushing teeth 123 after parts of the molded bodies roughly crushed are crushed by the crusher 85.

The structure of the auxiliary crusher 85 is not limited thereto.

The slurry containing the alloy powder (alloy powder recycled by crushing the molded body) recovered by the filter unit 60 is preferably used as another slurry for use in the wet molding method for manufacturing a new rare earth sintered magnet. This is because the properties of the new slurry whose oxidation is suppressed can be made full use of. In this case, only the recovered slurry may be used to perform the wet molding process. Instead, the recovered slurry may be mixed with another slurry newly produced to perform the wet molding process.

Alternatively, oil may be removed from the recovered slurry to produce the dried alloy powder. The alloy powder can be used for the dry molding method for manufacturing a new rare earth sintered magnet. In this case, only the thus-obtained dried alloy powder may be used to perform the dry molding process. Instead, the dried alloy powder may be mixed with another slurry newly produced to perform the dry molding process.

Obviously, the composition of the recycled alloy powder is identical to that of the alloy powder used for producing the molded body.

The alloy powder used for producing the molded body is a powder containing a rare earth element, preferably, an alloy powder for an R-T-B-based sintered magnet, and more preferably, an alloy powder for an R—Fe(Co)—B-M-based sintered magnet.

R is at least one element selected from the group consisting of neodymium (Nd), praseodymium (Pr), dysprosium (Dy) and terbium (Tb), and preferably contains at least one of Nd and Pr. More preferably, R is one of the combinations of rare earth elements selected from the group consisting of Nd—Dy, Nd—Tb, Nd—Pr—Dy and Nd—Pr—Tb. The element Dy and/or Tb has the effect of improving the coercive force.

The alloy powder may contain a small amount of another rare earth element, such as Ce or La, in addition to the above elements and, Mischmetal or didymium (alloy mainly containing Nd and Pr) may be used. The element R is not necessarily a pure element and may include inevitable impurities as long as it is available for industrial use. The content of the element R may be the well-known content, and a range of 25 to 35% by mass can be exemplified as a preferably range. For the content of the element R of less than 25% by mass, the alloy powder cannot sometimes obtain the adequate magnetic characteristics, especially, the high coersive force. On the other hand, for the content of the element R exceeding 35% by mass, the residual flux density of the alloy powder is sometimes reduced.

The element T contains Fe as an essential element, and may be replaced by Co by 50% by mass or less. The element Co is effective for improving the temperature characteristics and corrosion resistance. In general, 10% by mass or less of Co and a balance of Fe are used in combination. The content of the element T occupies the remainder of the R—B compound, or R—B (boron) compound, or R—B-M compound.

The content of the element B may be the well-known content, and a range of 0.9 to 1.2% by mass can be exemplified as a preferable range. For the content of the element B of 0.9% by mass or less, the alloy powder cannot sometimes obtain the high coersive force. On the other hand, for the content of the element B of 1.2% by mass or more, the residual flux density of the alloy powder is sometimes reduced.

A part of the elements B may be replaced by the element C (carbon). The replacement by the element C has the effect of improving the corrosion resistance of the magnet. In adding the elements B and C, the contents of the elements B and C are preferably controlled so as to have the above preferable content of the element B by converting the number of substitutional C (carbon) atoms into the number of B atoms.

In addition to the above elements, the element M can be added for improving the coersive force. The element M is at least one element selected from the group consisting of Al, Si, Ti, V, Cr, Ni, Cu, Zn, Ga, Zr, Nb, Mo, In, Sn, Hf, Ta and W. The amount of addition of the element M is preferably equal to or less than 2% by mass. When the addition amount of the element M exceeds 2% by mass, the residual flux density of the alloy powder might be reduced.

Inevitable impurities can be contained. For example, inevitable impurities include Mn and Cr introduced from Fe, and Al, Si, Cu, and the like introduced from Fe—B (ferroboron).

This application claims priority on Japanese Patent Application No. 2011-216466, the disclosure of which is incorporated by reference herein.

DESCRIPTION OF REFERENCE NUMERALS

12 First support bar
13 First crushing member
14 First crushing tooth
22 Second support bar
23 Second crushing member
24 Second crushing tooth
32 Third support bar
33 Third crushing member
34 Third crushing tooth
40 Rotary shaft
42A, 42B Fixing member
45, 47 Fin
46, 62, 92 Motor
48 Rotary wing
50 Crusher
60 Filter unit
61 First filter portion
63 Second filter portion
64 Punching metal
65 Opening
70 Tank
81, 82 Valve
83 Pump
85 Auxiliary crusher
90 Lifting and lowering unit

The invention claimed is:

1. A method for recycling a powder containing a rare earth element, comprising the steps of:

i) placing in an oil a molded body for a rare earth sintered magnet, the molded body comprising a powder containing a rare earth element;

ii) arranging the oil and at least a part of the molded body in between a plurality of plate-like first crushing teeth opposed to each other and a plate-like second crushing tooth having at least its part positioned between the adjacent first crushing teeth;

iii) rotating at least either one of the plurality of first crushing teeth and the second crushing tooth without contacting to each other such that the first crushing teeth and the second crushing tooth serve to change a part of the second crushing tooth positioned between the adjacent first crushing teeth.

2. The method according to claim 1, wherein after placing the molded body in the oil within a tank, the first crushing teeth and the second crushing tooth are inserted into the tank to thereby perform the steps ii) and iii).

3. The method according to claim 1, wherein the first crushing teeth are attached to a first support bar extending vertically from a rotary shaft, and the second crushing tooth is attached to a second support bar having a longitudinal direction thereof disposed vertically with respect to the rotary shaft, so that the first crushing teeth are rotated by rotating the rotary shaft.

4. The method according to claim 1, further comprising the step of, after the steps i) to iii), performing filtering for separation of a crushed powder having substantially the same particle diameter as that of the powder containing the rare earth element used for forming the molded body.

5. A recycle apparatus for recycling a powder for a rare earth sintered magnet, the recycle apparatus being adapted to crush a molded body for a rare earth sintered magnet comprising a powder containing a rare earth element, thereby producing a powder containing the rare earth element and having substantially the same particle diameter as that of a powder provided before molding the molded body, the recycle apparatus comprising:

a crusher including a plurality of plate-like first crushing teeth opposed to each other, and a plate-like second crushing tooth having at least a part thereof movable between the adjacent first crushing teeth, at least either one of the plurality of first crushing teeth and the second crushing tooth being adapted to rotate without contacting to each other so as to change a part of the second crushing tooth positioned between the adjacent first crushing teeth;

a movable tank for storing therein the molded body and an oil;

a lifting and lowering unit for inserting the crusher from an opening of the tank thereinto; and a filter unit for separating the powder containing the rare earth element and having a predetermined particle diameter, from the crushed molded body contained in the oil fed from the tank.

6. The recycle apparatus according to claim 5, wherein the first crushing teeth are attached to a first support bar extending vertically from a rotary shaft, and the second crushing tooth is attached to a second support bar having a longitudinal direction thereof disposed vertically with respect to the rotary shaft, so that the first crushing teeth are rotated by rotating the rotary shaft.

7. The recycle apparatus according to claim 6, further comprising:

a third support bar located under the first support bar and extending vertically from the rotary shaft; and a plurality of plate-like third crushing teeth attached to the third support bar to be opposed to each other, wherein at least a part of the second crushing tooth is movable between the adjacent third crushing teeth, and wherein the third crushing teeth are rotated by rotating the rotary shaft to change a part of the second crushing tooth positioned between the adjacent third crushing teeth.

* * * * *